US007528694B2

(12) United States Patent
Tseng et al.

(10) Patent No.: US 7,528,694 B2
(45) Date of Patent: May 5, 2009

(54) TRANSFORMER AND CORE SET THEREOF

(75) Inventors: Hsiang-Yi Tseng, Taoyuan Hsien (TW); Chen-Feng Wu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/649,243

(22) Filed: Jan. 4, 2007

(65) Prior Publication Data

US 2007/0216511 A1 Sep. 20, 2007

(30) Foreign Application Priority Data

Mar. 17, 2006 (TW) ..... 95109133 A

(51) Int. Cl.
*H01F 27/24* (2006.01)
*H01F 27/30* (2006.01)

(52) U.S. Cl. ..... 336/212; 336/208; 336/198

(58) Field of Classification Search ..... 336/212, 336/208, 198, 192, 220, 222
See application file for complete search history.

(56) References Cited

U.S. PATENT DOCUMENTS 5,184,105 A * 2/1993 Endo ..... 336/192
6,078,240 A * 6/2000 Huang ..... 336/90
7,280,022 B2 * 10/2007 Shinmen et al. ..... 336/83
7,301,430 B1 * 11/2007 Chan et al. ..... 336/200
2002/0121955 A1 * 9/2002 Yeh et al. ..... 336/198
2006/0181384 A1 * 8/2006 Hsueh et al. ..... 336/122

FOREIGN PATENT DOCUMENTS

JP 02138713 A * 5/1990
JP 200217048 A * 8/2002

* cited by examiner

*Primary Examiner*—Anh T Mai
(74) *Attorney, Agent, or Firm*—Birch, Stewart, Kolasch & Birch, LLP

(57) ABSTRACT

A transformer. The transformer comprises a bobbin, a first core and a second core. The bobbin comprises a primary winding area and a secondary winding area. The first core is disposed in the bobbin. The second core is mounted on the bobbin. The second core comprises a plurality of first protrusions which are disposed at two sides of the bobbin. A second protrusion is integrally formed on the second core and is disposed between the first protrusions. The second protrusion is disposed between the primary winding area and the secondary winding area.

18 Claims, 10 Drawing Sheets

3

5

5

TRANSFORMER AND CORE SET THEREOF

BACKGROUND OF THE INVENTION

1. Field of the Invention

The invention relates to a transformer and a core assembly thereof, and in particular relates to a transformer and a core set thereof for enhancing leakage inductance.

2. Description of the Related Art

Due to a demand for thinner monitors, liquid crystal displays (LCDs) have merits for reducing the thickness and having a high-quality frame. Consequently, the LCDs have rapidly replaced CRT monitors. A backlight module of an LCD monitor comprises a cold cathode fluorescent lamp (CCFL), driven by high voltage, to serve as a light source for the backlight system of the LCD. In general, the CCFL is driven by an inverter, which comprises a drive circuit and a high-voltage transformer.

Although LCD monitors are much thinner than CRT monitors, size requirements for LCD monitors continue to grow. Thus, the length of the CCFL must be increased. The leakage capacitance is therefore increased due to the increased LCD monitor size. To improve entire efficiency and the balance of tube current, matching the leakage inductance and the leakage capacitance is performed to decrease the damage of the transformer. Accordingly, the leakage inductance is necessarily increased for matching up with the increased leakage capacitance.

Referring to FIG. 1A and FIG. 1C, a conventional transformer 1 comprises a bobbin 10 and two cores 20. The bobbin 10 comprises a primary winding area 11 and two secondary winding areas 12. The primary winding area 11 is at the center of the bobbin 10, and the two secondary winding areas 12 are at two sides of the primary winding area 11, and furthermore, the bobbin 10 has a hollow portion 13 therein. The two cores 20 are E-shaped. Each core 20 has a protrusion 21 at the middle and are inserted respectively into the hollow portion 13 from two opposite sides of the bobbin 10. A cover 14 covers the bobbin 10. The cover 14 is made of the insulated materials, and the shape of the cover 14 fits the shape of the bobbin 10. The cover 14 protects a primary coil (not shown) and two secondary coils (not shown), both of which are wound around the primary winding area 11 and the two secondary winding areas 12. The cover 14 comprises an opening 141 in the axial direction to allow the protrusions 21 of the two cores 20 to pass therethrough. Additionally, a gap A (as shown in FIG. 1B) of the conventional transformer 1 is formed between two arms 22 of the cores 20.

The number of the coils or the distance between the primary coils and the secondary coils can adjust the leakage inductance of the conventional transformer 1. However, the space of the winding area 11 and 12 and the length of two cores 20 be increased. Also, it increases the volume of the transformer 1. If the coil diameter is decreased to substitute for changing the available space for winding areas 11 and 12, the temperature will increase. Thus, the conventional transformers need to be improved.

Referring to FIG. 2A and FIG. 2C, a conventional transformer 2 comprises a bobbin 10, a first core 30 and a second core 40. The bobbin 10 comprises a primary winding area 11 and two secondary winding areas 12. The primary winding area 11 is at the center of the bobbin 10, and the two secondary winding areas 12 are at two sides of the primary winding area 11. Additionally, the bobbin 10 has a hollow portion 13 therein, and is covered by a cover 14. The cover 14 is made of the insulated materials. The shape of the cover 14 fits the shape of the bobbin 10. The cover 14 protects a primary coil (not shown) and the two secondary coils (not shown), both of which are wound around the primary winding area 11 and two secondary winding areas 12. The cover 14 comprises an opening 141. The first core 30 is I-shaped, and disposed in the hollow portion 13 of the bobbin 10 and the opening 141 of the cover 14. The second core 40 is frame-shaped, and mounted on the cover 14. The second core 40 comprises protrusions with U-shaped cross sections at both ends. Each protrusion comprises two protrusions 41. Additionally, a gap B (as shown in FIG. 2B) of the conventional transformer 2 is formed between the first core 30 and the protrusions 41 of the second core 40.

The size of the gap B, the number of the coils or the distance between the primary coils and the secondary coils can adjust the leakage inductance of the conventional transformer 2. It is therefore understood that conventional transformer 2 has the same drawbacks as the conventional transformer 1. Accordingly, the conventional transformer 2 needs to be improved.

BRIEF SUMMARY OF THE INVENTION

Accordingly, an object of the invention is to provide a transformer, which changes the magnetic circuit to enhance the leakage inductance by at least a protrusion of the core set.

Another object of the invention is to provide a core set, which is to solve the problem in the conventional transformer due to drawbacks in increasing the volume and the number of coils to enhance the leakage inductance.

According to the foregoing objects and others, the present invention provides a transformer comprises a bobbin having a hollow portion, a primary winding area and at least a secondary winding area, a first core disposed in the hollow portion of the bobbin, and a second core disposed on the bobbin, wherein the second core comprises a plurality of first protrusions and at least a second protrusion, and the first protrusions which are disposed at two sides of the bobbin and the second protrusion is disposed between the primary winding area and the secondary winding area.

According to the foregoing objects and others, the present invention provides a core set disposed on a bobbin having a hollow portion, a primary winding area and a secondary winding area, the core set comprising a first core and a second core having a plurality of first protrusions and a second protrusion thereon, wherein the first core is disposed in the hollow portion of the bobbin, and the first protrusions of the second core are disposed at two sides of the bobbin and the second protrusion of the second core is disposed between the primary winding area and the second winding area.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1A:
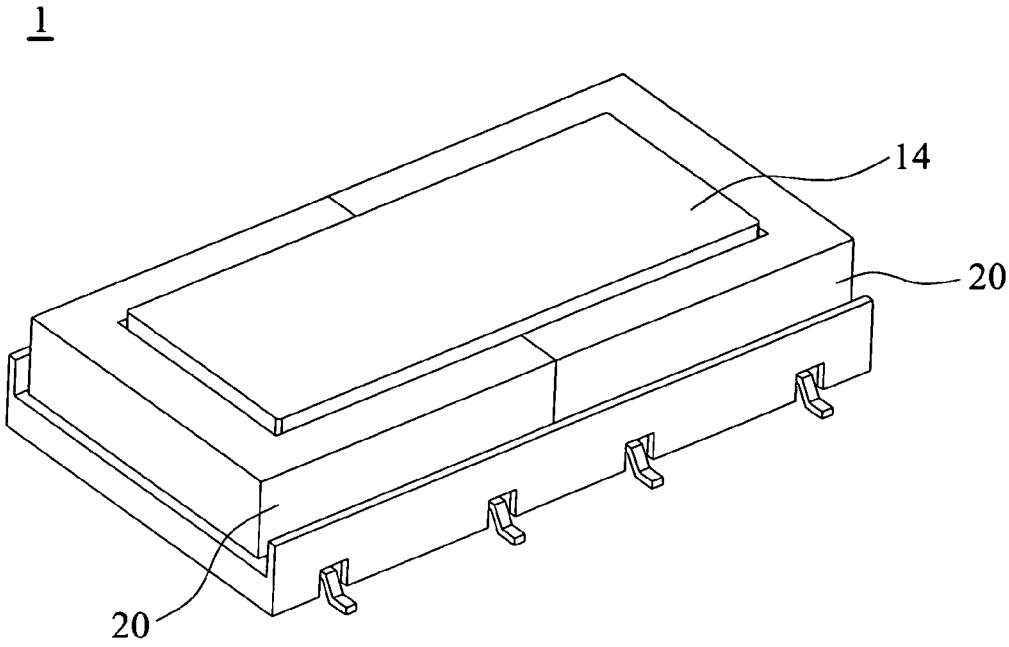
FIG. 1A (RELATED ART)
FIG. 1A is a schematic view of a conventional transformer.
Figure 1B:
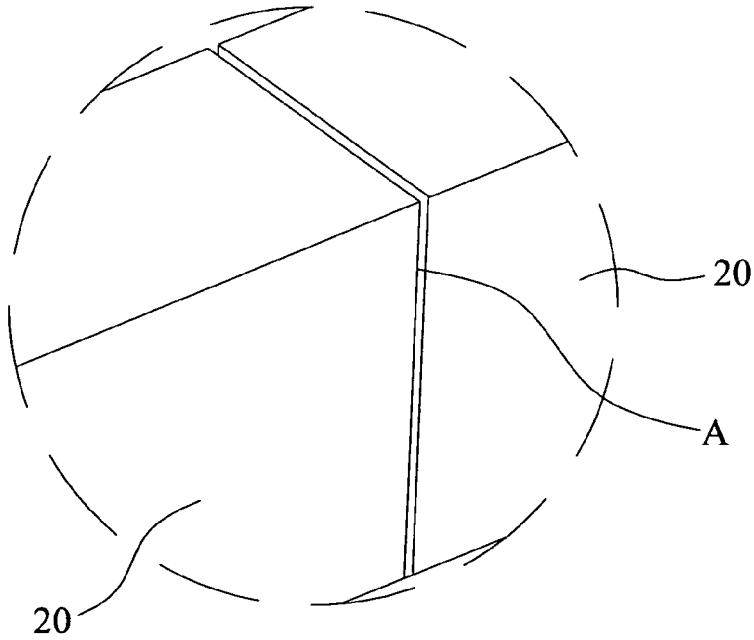
FIG. 1B (RELATED ART)
FIG. 1B is a partially magnified schematic view in FIG. 1A.
Figure 1C:
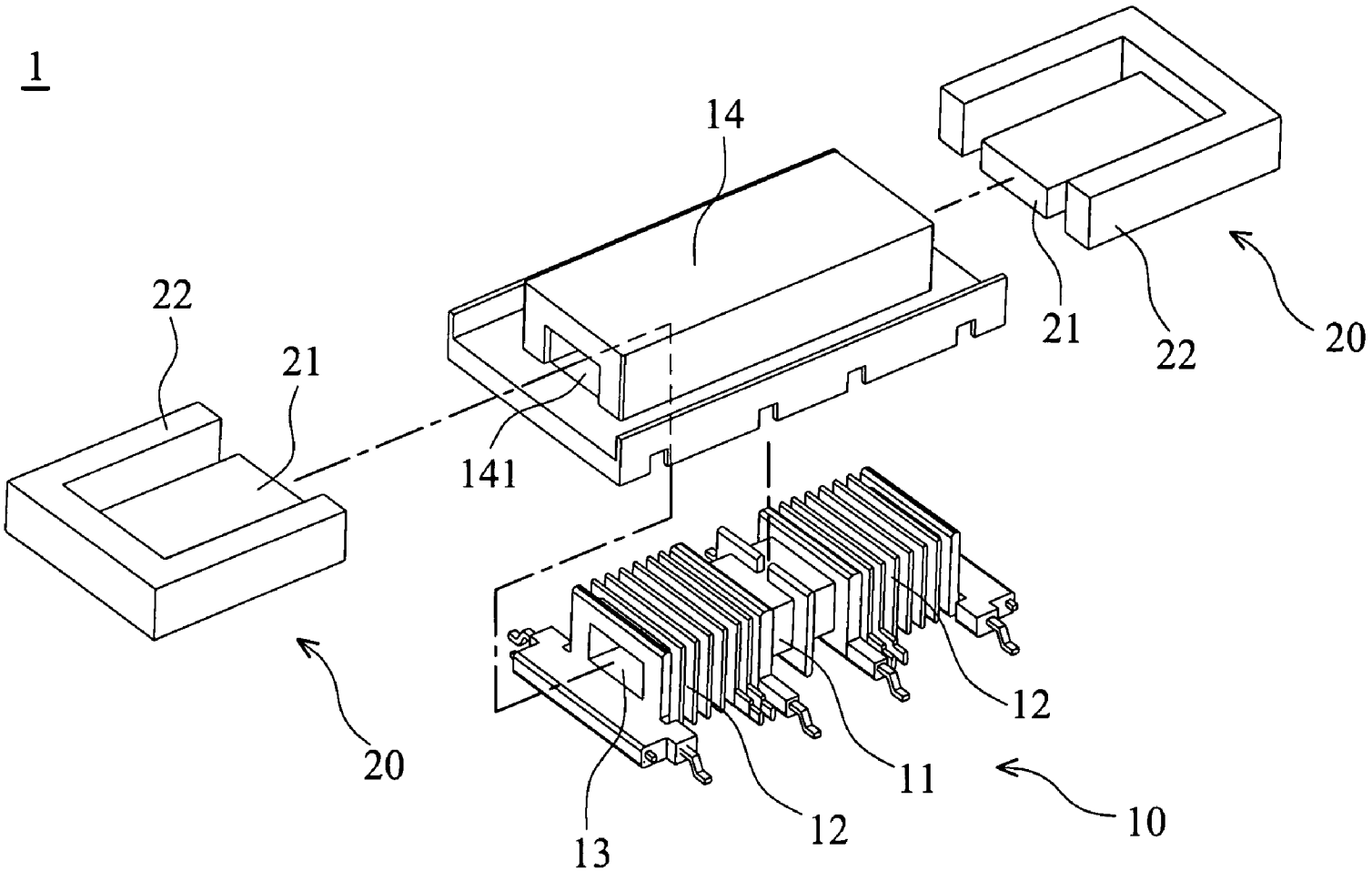
FIG. 1C (RELATED ART)
FIG. 1C is an exploded schematic view of the conventional transformer.
Figure 2A:
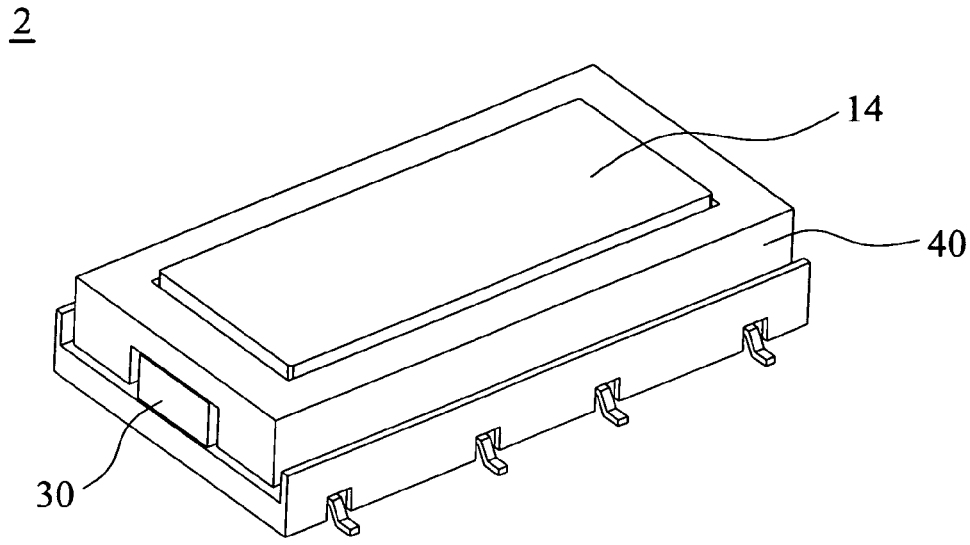
FIG. 2A (RELATED ART)
FIG. 2A is a schematic view of another conventional transformer.
Figure 2B:
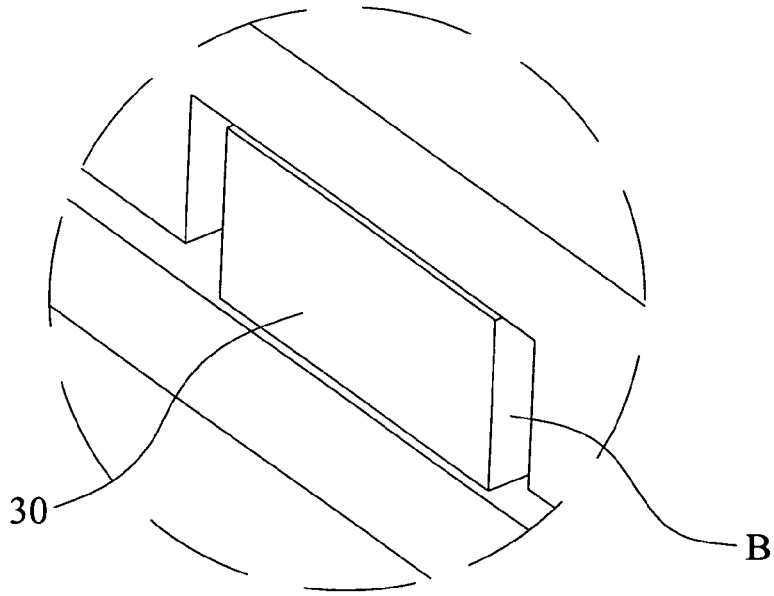
FIG. 2B (RELATED ART)
FIG. 2B is a partially magnified schematic view in FIG. 2A.
Figure 2C:
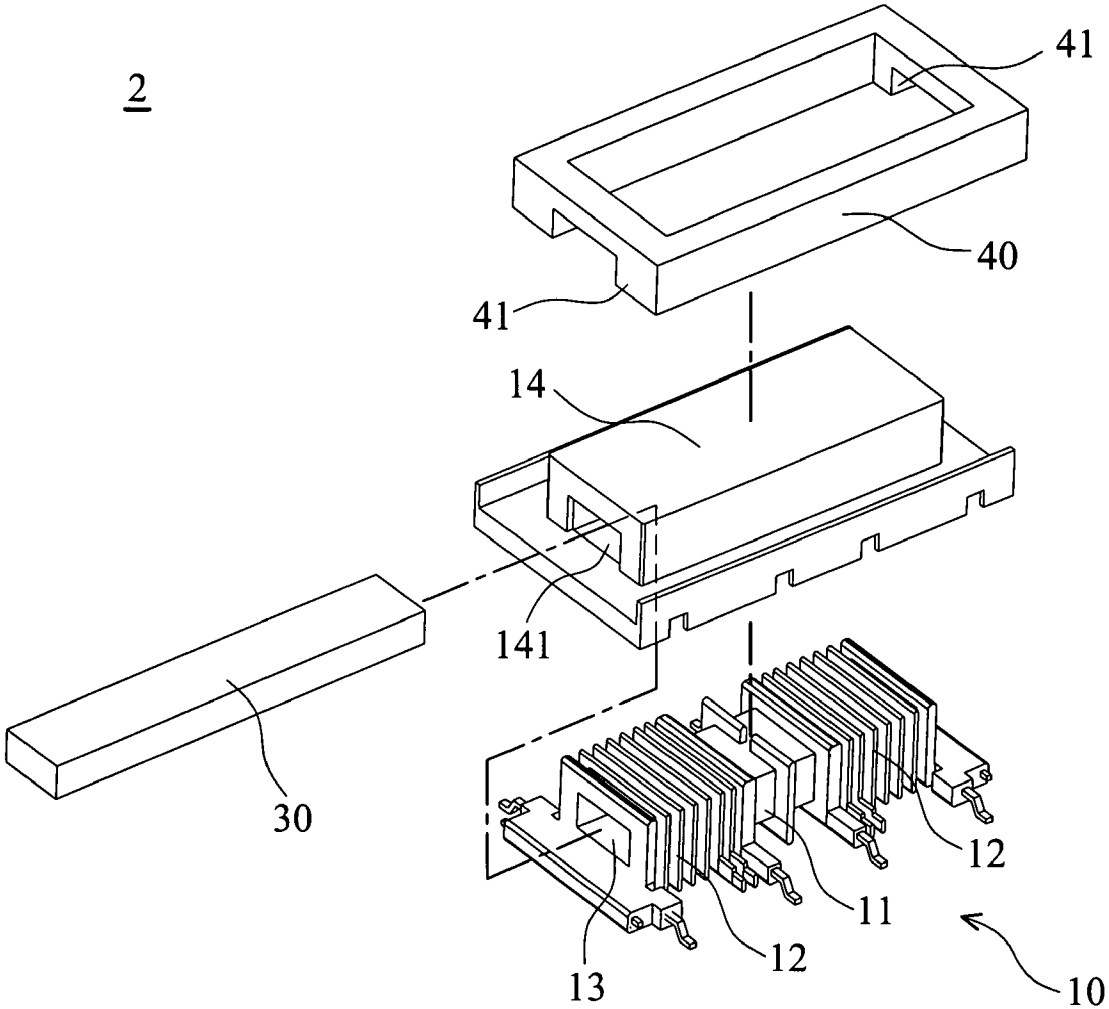
FIG. 2C (RELATED ART)
FIG. 2C is an exploded schematic view of the another conventional transformer.
Figure 3A:
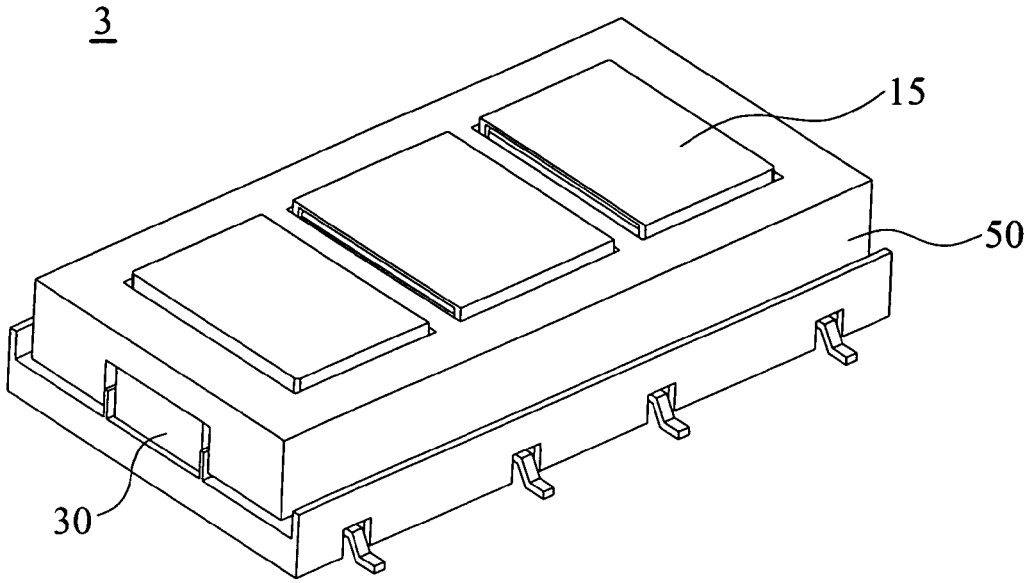
FIG. 3A is a schematic view of a first embodiment of a transformer of the invention.
Figure 3B:
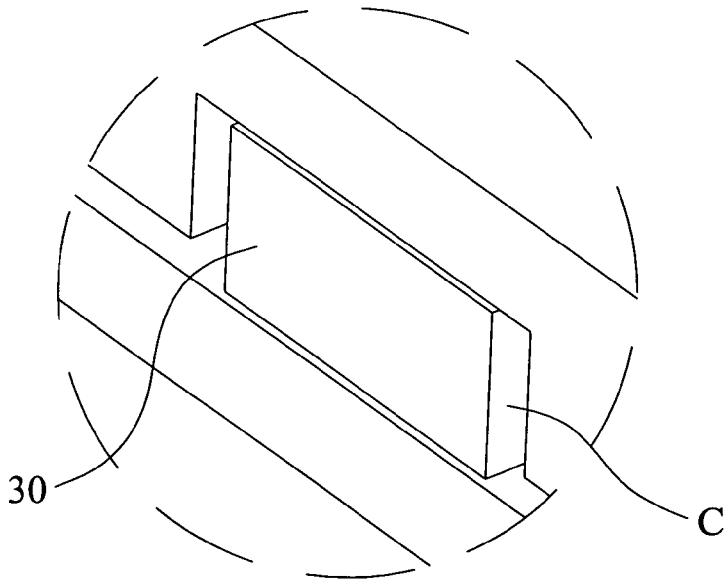
FIG. 3B is a partially magnified schematic view in FIG. 3A.
Figure 3C:
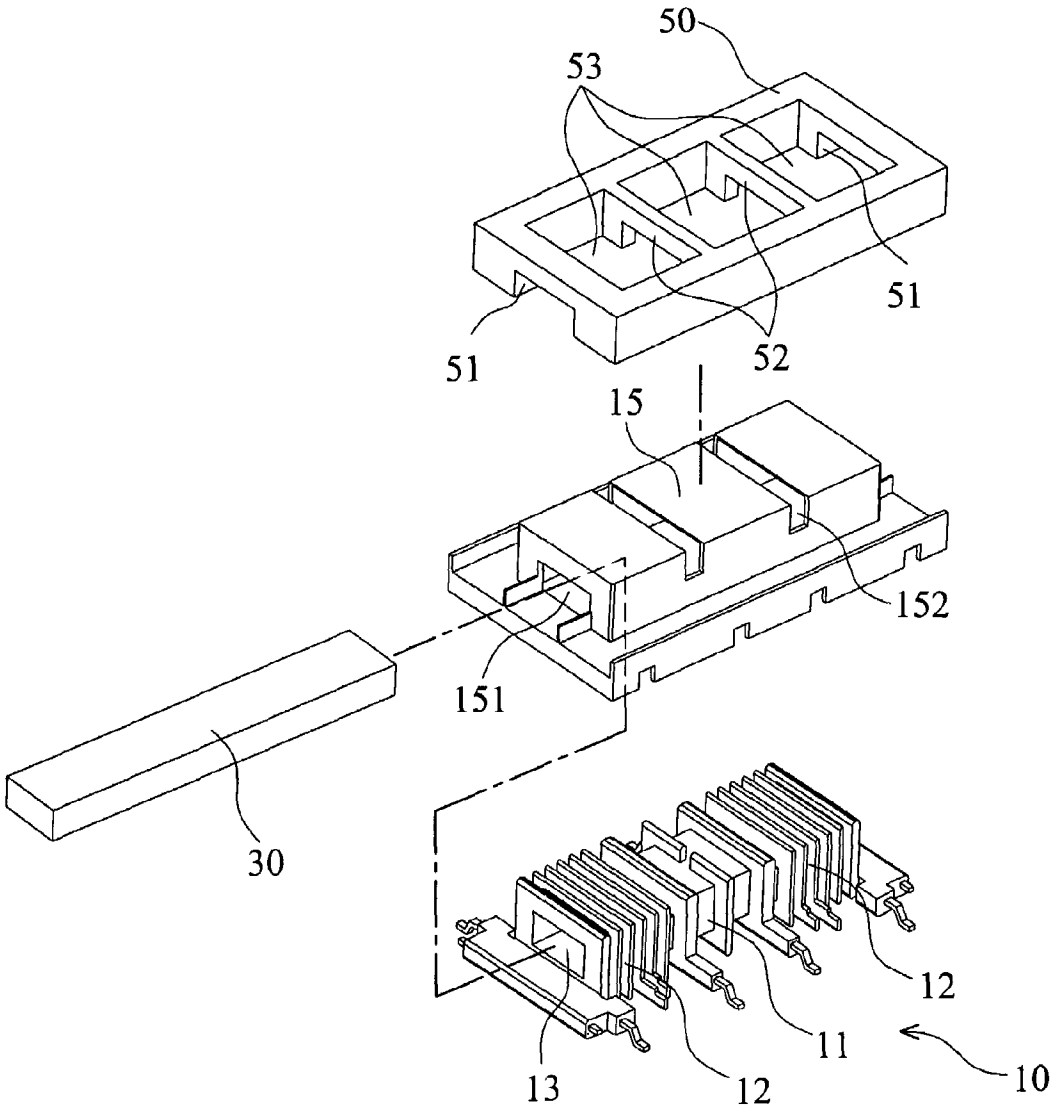
FIG. 3C is a exploded schematic view of the first embodiment of a transformer of the invention.

Referring to FIG. 3A and FIG. 3C, the transformer 3 of a first embodiment of the invention comprises a bobbin 10 and a set of cores. The set of cores comprises a first core 30 and a second core 50. The bobbin 10 comprises a primary winding area 11 and two secondary winding areas 12. The primary winding area 11 is at the center of the bobbin 10. The two secondary winding areas 12 are at two sides of the primary winding area 11. One primary coil or two primary coils (not shown) are wound around the primary winding area 11, and a secondary coil (not shown) is wound around the secondary winding areas 12. The bobbin 10 has a hollow portion 13 therein. The first core 30 is I-shaped, and disposed in the hollow portion 13 of the bobbin 10. The second core 50 is mounted on the bobbin 10, and comprises a plurality of first protrusions 51 and two second protrusions 52. The first protrusions 51 are disposed at two sides of the bobbin 10. The two second protrusions 52 are disposed between the first protrusions 51. The first and second protrusions are integrally on the second core 50. Furthermore, the two second protrusions 52 are between the primary winding area 11 and two secondary winding areas 12.

The second core 50 further comprises three through holes 53 formed between the first protrusions 51 and the second protrusions 52. Thus, the shape of the second core 50 is three rectangles connected together along a straight line. Furthermore, the width of the first protrusions 51 can be larger than, smaller than, or equal to the width of the second protrusion. (In FIG. 3C, the width of first protrusion is larger than that of the second protrusion.). The cross sections of the first protrusions 51 and the second protrusions 52 of the second core 50 are U-shaped, and a gap C is formed between the first core 30 and the second core 50 (as shown in FIG. 3B).

Additionally, the first core 30 and the second core 50 are made of metal magnetic materials, such as Mn—Zn materials, Ni—Zn materials, Mg—Zn materials, permeable magnetic materials, or stacked silicon steel. When the first core 30 and the second core 50 are stacked with Mn—Zn materials or silicon steel, a cover 15 is disposed between the bobbin 10 and the second core 50. The cover 15 is made of insulated materials, e.g. plastic. The shape of the cover 15 fits the shape of the bobbin 10. The cover 15 has a bottom and a plurality of sidewalls connected to the bottom, and the cover 15 covers the bobbin 10. The cover 15 is mounted on the bobbin 10 to protect a primary coil (not shown) and two secondary coils (not shown). Subsequently, the second core 50 is mounted on the bobbin 10. The cover 15 comprises an opening 151 formed on one of the sidewalls of the bobbin 10, and is correspondingly to the hollow portion 13 of the bobbin 10. Therefore, the first core 30 is inserted into the hollow portion of the bobbin 10 when the cover 15 covers the bobbin 10. Additionally, the cover 15 comprises two through holes 152 formed on the bottom of the bobbin 10 corresponding to the second protrusions 52 of the second core 50. Therefore, the second protrusions 52 pass through the cover 15 and are disposed between the first primary winding area 11 and the second winding areas 12.

Furthermore, when the second core 50 is made of Mn—Zn materials or stacked silicon steels, the cover can be omitted by increasing the intervals between the primary winding area 11 of the bobbin 10 and the secondary winding area 12.

The number of the magnetic circuits formed by the first core 30 and the second core 50 is increased due to the two second protrusions 52 of the second core 2 of the transformer 3; thus, the leakage inductance is increased without increasing the number of coils or the volume of the transformer. It is therefore improved upon the drawbacks of conventional transformers.

Second Embodiment

Figure 4A:
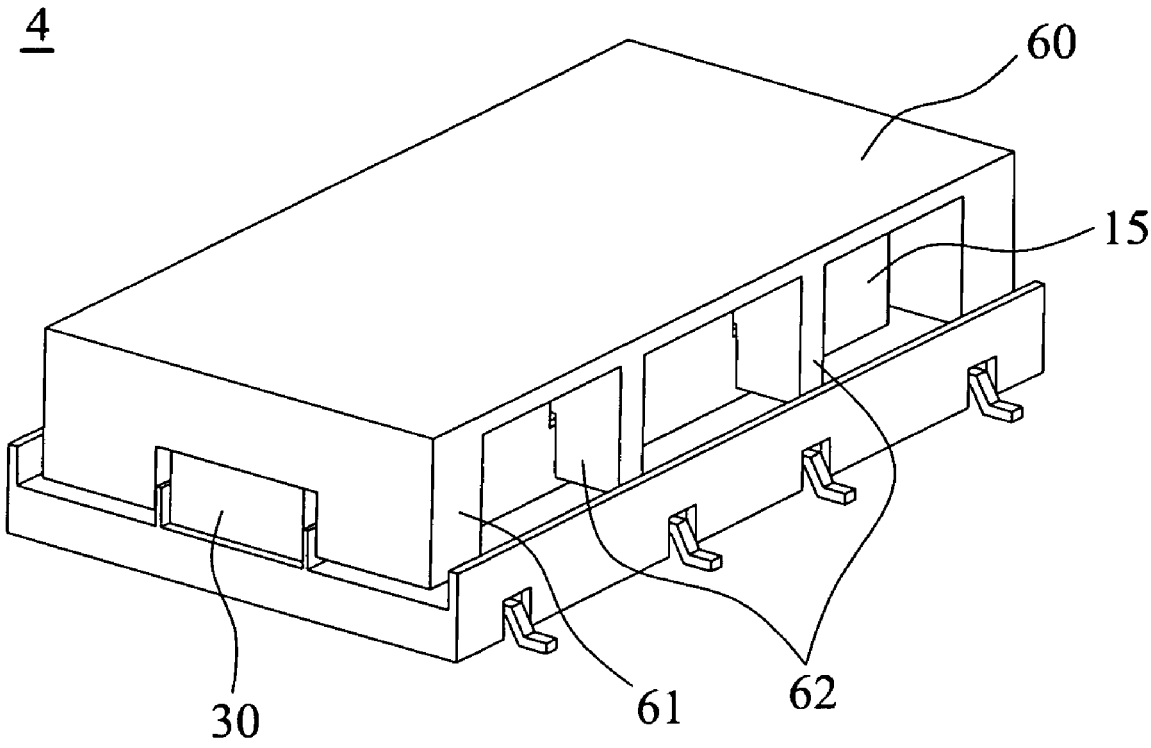
FIG. 4A is a schematic view of a second embodiment of a transformer of the invention.
Figure 4B:
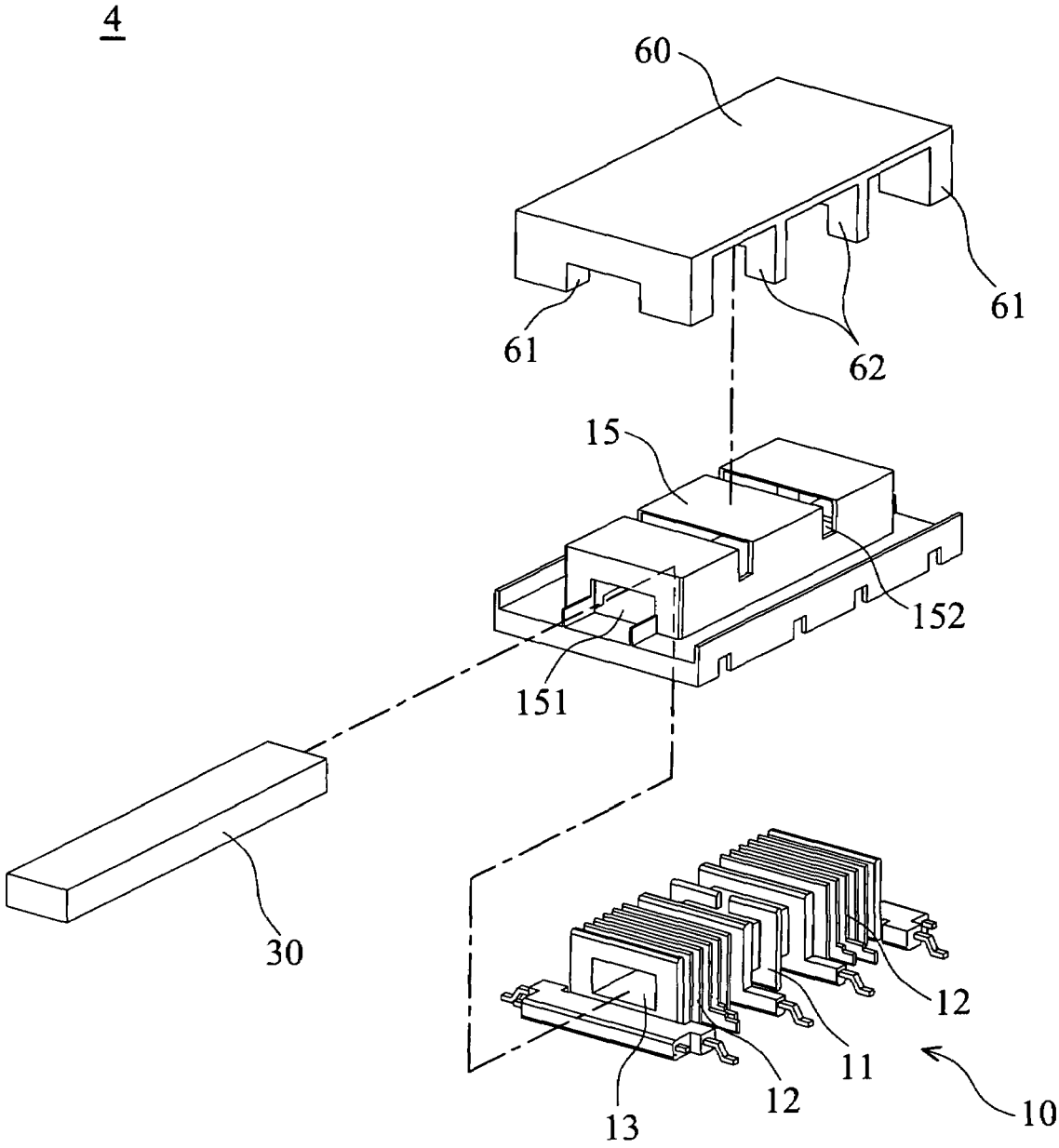
FIG. 4B is a exploded schematic view of the second embodiment of a transformer of the invention.

Referring to FIG. 4A and FIG. 4B, a second embodiment of the transformer 4 of a second embodiment of the invention comprises a bobbin 10, a first core 30, and a second core 60. The structures of the bobbin 10 and the first core 30 in the second embodiment are identical to those in the first embodiment. Furthermore, the function of the second core 60 in this embodiment is similar to that of the second core 50 in the first embodiment. The difference between the first embodiment and the second embodiment is that the second core 60 has no through holes 53. Hence, the cover 15 is not exposed.

In this embodiment, the magnetic circuits are changed because the second core 60 of the transformer 4 further comprises two second protrusions 62 to enhance the leakage inductance.

Third Embodiment

Figure 5A:
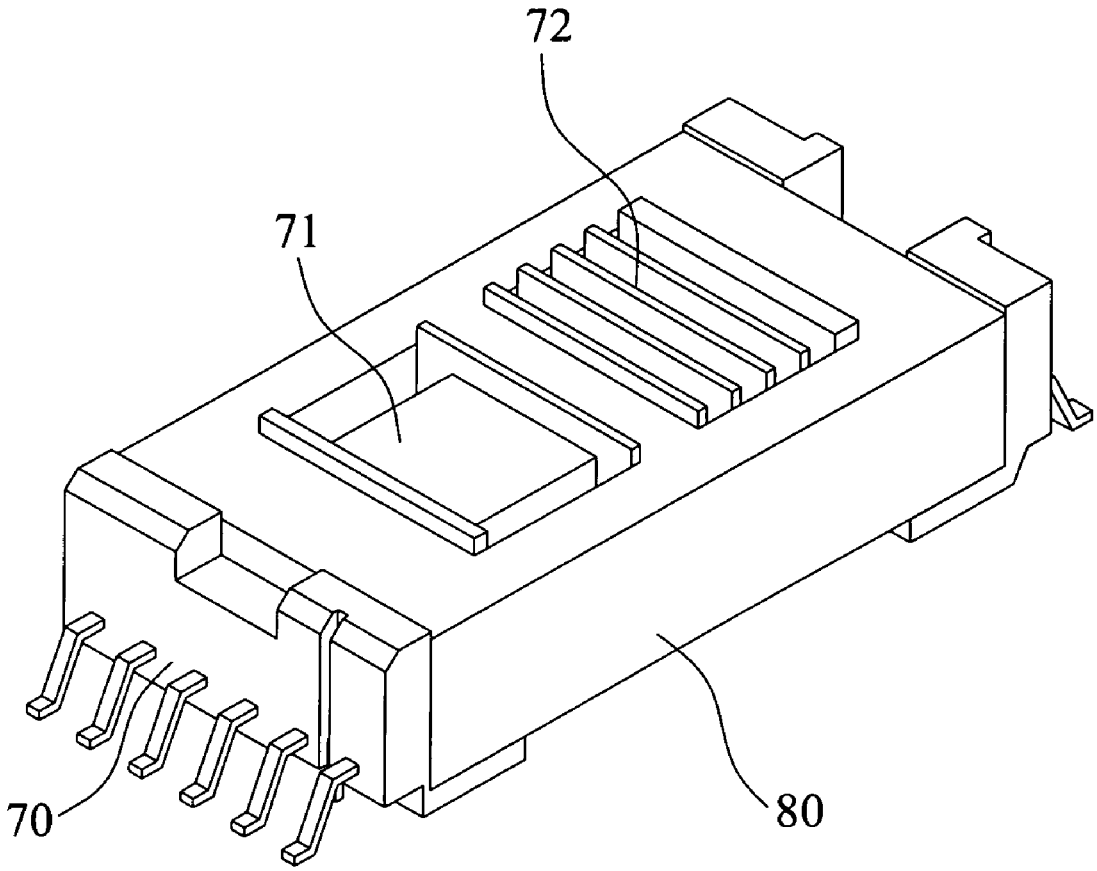
FIG. 5A is a schematic view of a third embodiment of a transformer of the invention.
Figure 5B:
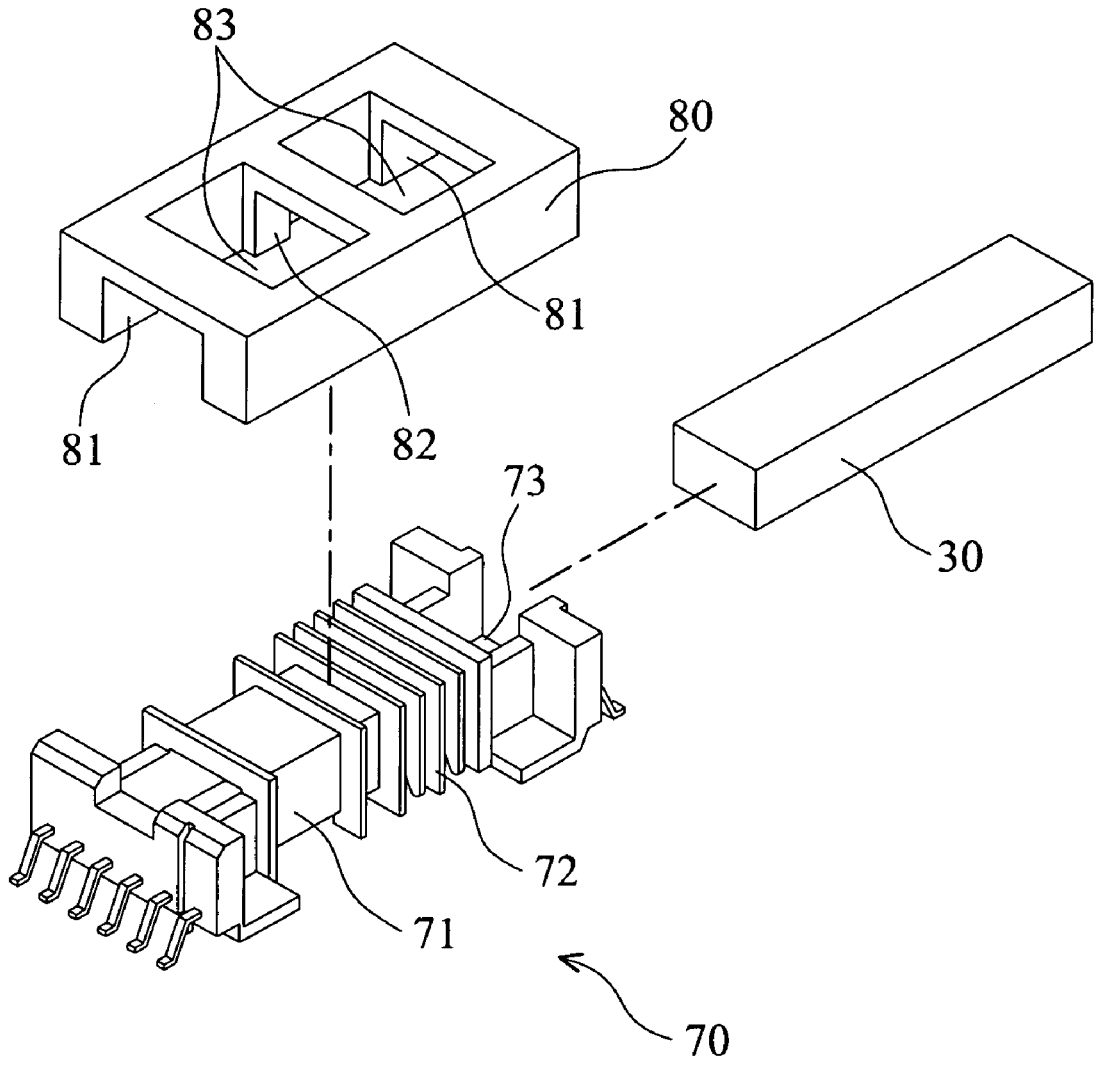
FIG. 5B is an exploded schematic view of the second embodiment of a transformer of the invention.

Referring to FIG. 5A and FIG. 5B, a transformer 5 of a third embodiment of the invention comprises a bobbin 70, a firs core 30, and a second core 80. The bobbin 70 comprises a primary winding area 71 and a secondary winding area 72. The primary winding area 71 is wound by one primary coil or two primary coils (not shown), and the secondary winding area 72 is wound by a secondary coil (not shown). Furthermore, the bobbin 70 comprises a hollow portion 73 therein. The first core 30 is I-shaped, and disposed in the hollow portion 73 of the bobbin 70. The second core 80 is mounted on the bobbin 70, and comprises two first protrusions 81 and a second protrusion 82. The first protrusions 81 are disposed at two sides of the bobbin 70. The second protrusions 82 is disposed between the first protrusions 81, and integrally formed with the second core 80. The second protrusion 82 is disposed between the primary winding area 71 and the secondary winding area 72.

The second core 80 further comprises two through holes 83. The through holes 83 are formed between the first protrusions 81 and second protrusion 82. Thus, the shape of the second core 80 is two rectangles connected together along a straight line. Furthermore, the first protrusions 81 are wider than the second protrusion 82. The cross sections of the first protrusions 81 and the second protrusion 82 of the second core 80 are U-shaped to form gap between the first core 30 and the second core 80 (not shown).

When the second core 50 is made of Mn—Zn materials or stacked silicon steel, a cover can be disposed between the bobbin 70 and the second core 80. The cover is made of insulated materials. The shape of the cover 14 fits the shape of the bobbin 70 for the purpose of assembling the cover 14 and the bobbin 70. The structure of and the function of the cover is similar to the previously described cover, thus the descriptions and figures thereof are omitted.

In this embodiment, the magnetic circuits are changed because the second core 80 of the transformer 5 further comprises the two second protrusions 82, to enhance leakage inductance.

In the invention, the transformer and the core assembly thereof comprise at least a protrusion between the primary coil and secondary coil to change the number of the magnetic circuits. Then, the leakage inductance is enhanced to fit the leakage capacitance. Hence, the total efficiency is promoted and the tube current is balanced without increasing the number of coils and the size of the transformer.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A transformer comprising:

a bobbin having a hollow portion, a primary winding area and at least a secondary winding area;

a first core disposed in the hollow portion of the bobbin;

a second core disposed on the bobbin, wherein the second core comprises a plurality of first protrusions and at least a second protrusion, and the first protrusions are disposed at two sides of the bobbin and the second protrusion is disposed between the primary winding area and the secondary winding area; and a cover, covering the bobbin and allowing the second core to be mounted thereon, wherein the cover comprises at least one through hole formed corresponding to the second protrusion to allow the second protrusion to pass through the through hole to be disposed between the primary winding area and the secondary winding area.

2. The transformer as claimed in claim 1, wherein the second protrusion is integrated to the second core and disposed between the first protrusions.

3. The transformer as claimed in claim 1, wherein the secondary winding area is at one side of the bobbin and neighbored to the primary winding area.

4. The transformer as claimed in claim 1, wherein the first core is I-shaped, and the second core has a U-shaped cross section.

5. The transformer as claimed in claim 4, wherein a gap is formed between the first core and the second core.

6. The transformer as claimed in claim 1, wherein the shape of the second core is two rectangles connected to each other, or three rectangles connected to each other.

7. The transformer as claimed in claim 1, wherein the first core and the second core are made of Mn—Zn material, Ni—Zn material, Mg—Zn material, permeability magnetic materials, or stacked silicon steel.

8. The transformer as claimed in claim 1, wherein the cover comprises an opening disposed corresponding to the hollow portion of the bobbin to allow the first core to be disposed in the hollow portion of the bobbin.

9. The transformer as claimed in claim 1, wherein the cover is made of insulated materials.

10. The transformer as claimed in claim 1, wherein the width of the first protrusion is larger than, smaller than, or equal to that of the second protrusion.

11. The transformer as claimed in claim 1, wherein the second core comprises at least two through holes disposed between the first protrusions and the second protrusion.

12. A core set disposed on a bobbin having a hollow portion, a primary winding area and a secondary winding area, the core set comprising:

a first core and a second core having a plurality of first protrusions and a second protrusion, wherein the first core is disposed in the hollow portion of the bobbin, and the first protrusions of the second core are disposed at two sides of the bobbin and the second protrusion of the second core is disposed between the primary winding area and the second winding area, wherein the second core comprises at least two through holes disposed between the first protrusions and the second protrusion.

13. The core set as claimed in claim 12, wherein the second protrusion is integrally on the second core and disposed between the first protrusions.

14. The core set as claimed in claim 12, wherein cross sections of the first protrusions and the second protrusion are U-shaped, and a gap is formed between the first core and the second core.

15. The core set as claimed in claim 12, wherein the shape of the second core is two rectangles connected to each other along a straight line, or three rectangles connected to each other along a straight line.

16. The core set as claimed in claim 12, wherein the core set is made of Mn—Zn material, Ni—Zn material , Mg—Zn material , permeable magnetic materials, or stacked silicon steel.

17. The core set as claimed in claim 12, wherein the width of the first protrusion is larger than, smaller than, or equal to the width of the second protrusion.

18. A transformer comprising:

a bobbin having a hollow portion, a primary winding area and at least a secondary winding area;

a first core disposed in the hollow portion of the bobbin; and a second core disposed on the bobbin, wherein the second core comprises a plurality of first protrusions, at least a second protrusion, and at least two through holes disposed between the first protrusions and the second protrusion, wherein the first protrusions are disposed at two sides of the bobbin and the second protrusion is disposed between the primary winding area and the secondary winding area.

* * * * *